US009080341B2

(12) United States Patent
Meiners

(10) Patent No.: US 9,080,341 B2
(45) Date of Patent: Jul. 14, 2015

(54) PARKING SYSTEM

(71) Applicant: Otto Woehr GmbH, Korntal-Muenchingen (DE)

(72) Inventor: Ruediger Meiners, Willstaett (DE)

(73) Assignee: Otto Woehr GmbH, Korntal-Muenchingen (DE)

( * ) Notice: Subject to any disclaimer, the term of this patent is extended or adjusted under 35 U.S.C. 154(b) by 19 days.

(21) Appl. No.: 13/740,366

(22) Filed: Jan. 14, 2013

(65) Prior Publication Data

US 2013/0183123 A1 Jul. 18, 2013

Related U.S. Application Data

(63) Continuation of application No. PCT/EP2011/062988, filed on Jul. 28, 2011.

(30) Foreign Application Priority Data

Aug. 12, 2010 (IL) ..... 207582

(51) Int. Cl.

| | |
|---|---|
| ***E04H 6/00*** | (2006.01) |
| ***E04H 6/12*** | (2006.01) |
| ***E04H 6/22*** | (2006.01) |
| ***E04H 6/42*** | (2006.01) |

(52) U.S. Cl.

CPC ..... *E04H 6/12* (2013.01); *E04H 6/225* (2013.01); *E04H 6/422* (2013.01)

(58) Field of Classification Search

CPC ..... E04H 6/08
USPC ..... 414/240, 231, 252
See application file for complete search history.

(56) References Cited

U.S. PATENT DOCUMENTS

| | | | | |
|---|---|---|---|---|
| 4,808,997 | A * | 2/1989 | Barkley et al. | 340/942 |
| 6,109,853 | A | 8/2000 | Paulmichl | |
| 6,560,927 | B2 * | 5/2003 | Schulte | 49/200 |
| 6,817,824 | B2 * | 11/2004 | Winkler | 414/273 |
| 2005/0220594 | A1 * | 10/2005 | Haag | 414/529 |
| 2005/0250443 | A1 * | 11/2005 | Rutten et al. | 455/41.2 |
| 2009/0053024 | A1 | 2/2009 | Myers | |

FOREIGN PATENT DOCUMENTS

| | | |
|---|---|---|
| DE | 89 16 249 | 3/1996 |
| DE | 101 51 916 | 5/2003 |

* cited by examiner

*Primary Examiner* — Saul Rodriguez
*Assistant Examiner* — Willie Berry, Jr.
(74) *Attorney, Agent, or Firm* — Lipsitz & McAllister, LLC

(57) ABSTRACT

A parking system is provided, having a plurality of motor vehicle parking spaces arranged next to and/or on top of one another, each defining a parking position for a motor vehicle, a transfer area defining a transfer position for the motor vehicle for transferring the motor vehicle from the user to the parking system and vice versa, a transporting device for transporting the motor vehicle between the transfer position and the parking position, a control device for controlling the transporting device, and a user operating device in operative communication with the control device. The control device controls the transporting device for transporting the motor vehicle from the parking position as far as a change-of-operation position and vice versa in automatic operation. The transporting device transports the motor vehicle from the change-of-operation position to the transfer position and vice versa in dead man operation upon user actuation of the operating device.

18 Claims, 4 Drawing Sheets

PARKING SYSTEM

CROSS-REFERENCE TO RELATED APPLICATIONS

Figure 1:
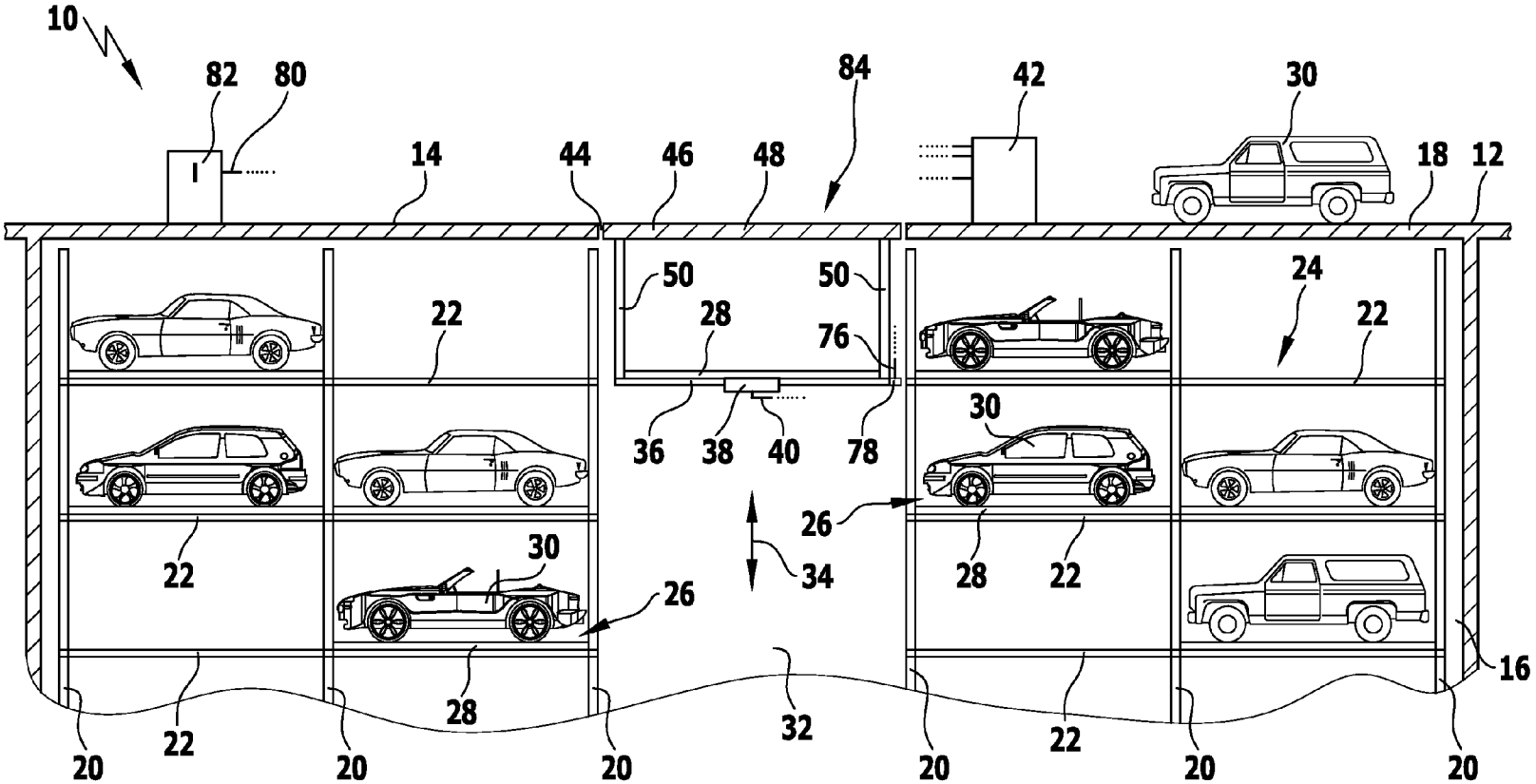

This application is a continuation of international application number PCT/EP2011/062988, filed on Jul. 28, 2011, and claims the benefit of Israeli application number 207582, filed on Aug. 12, 2010, which are incorporated herein by reference in their entirety and for all purposes.

FIELD OF THE INVENTION

The invention relates to a parking system, comprising a plurality of parking spaces for motor vehicles, which parking spaces are arranged next to one another and/or on top of one another and each define a parking position for a motor vehicle, a transfer area defining a transfer position for the motor vehicle for transferring the motor vehicle from the user to the parking system and vice versa, a transporting device for transporting the motor vehicle between the transfer position and a parking position, a control device for controlling the transporting device, and an operating device for the user which is in operative communication with the control device.

BACKGROUND OF THE INVENTION

Parking systems of this type serve the purpose of parking as many motor vehicles as possible in a space-saving manner and in as confined a space as possible. The parking spaces are normally formed as so-called "compartments" of a parking rack which is constructed from vertical and horizontal supports and into which motor vehicles cannot be driven. For this reason, the parking system comprises the transporting device, with which motor vehicles can be transported between the transfer area and the parking spaces. For their transport and for the purpose of parking, the motor vehicles are positioned, for example, on pallets which can be parked in the parking space by the transporting device and retrieved from the parking space again by the transporting device. The transporting device is controlled by the control device which controls the transport of a motor vehicle depending on instructions from a user given at the operating device.

An object underlying the present invention is to provide a generic parking system which allows a swift parking and retrieval of a motor vehicle and as space-saving a construction of the transfer area as possible.

SUMMARY OF THE INVENTION

In an aspect of the invention, a parking system comprises a plurality of parking spaces for motor vehicles, which parking spaces are arranged next to one another and/or on top of one another and each define a parking position for a motor vehicle, a transfer area defining a transfer position for the motor vehicle for transferring the motor vehicle from the user to the parking system and vice versa, a transporting device for transporting the motor vehicle between the transfer position and a parking position, a control device for controlling the transporting device, and an operating device for the user which is in operative communication with the control device. The control device controls the transporting device in such a manner that the transporting device transports the motor vehicle from a parking position as far as a change-of-operation position, which is arranged on the path of transport from the parking position to the transfer position, and vice versa in automatic operation, and that the transporting device transports the motor vehicle from the change-of-operation position to the transfer position and vice versa in dead man operation upon actuation of the operating device by the user.

BRIEF DESCRIPTION OF THE DRAWING FIGURES

Figure 2:
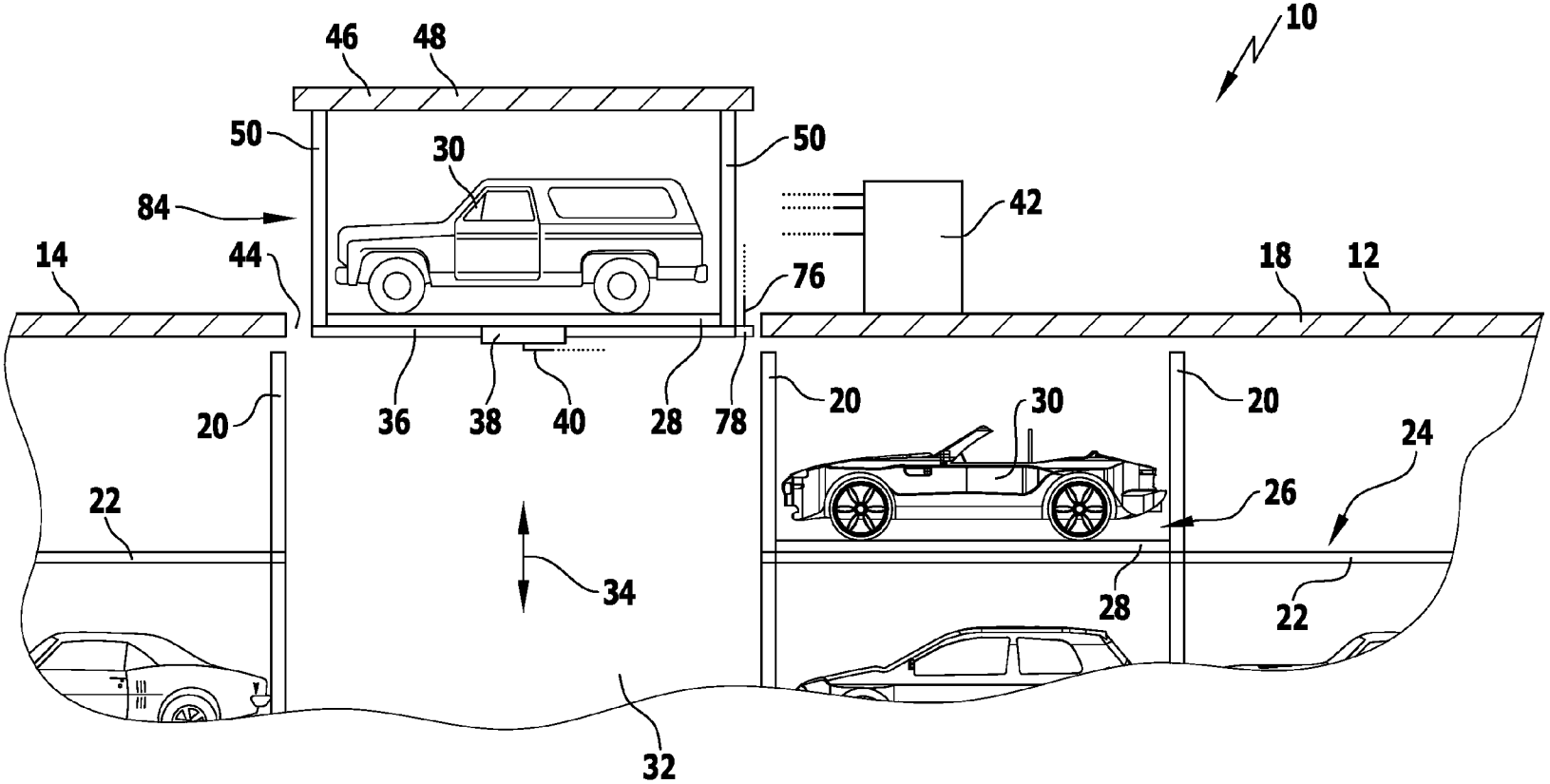
Figure 3:
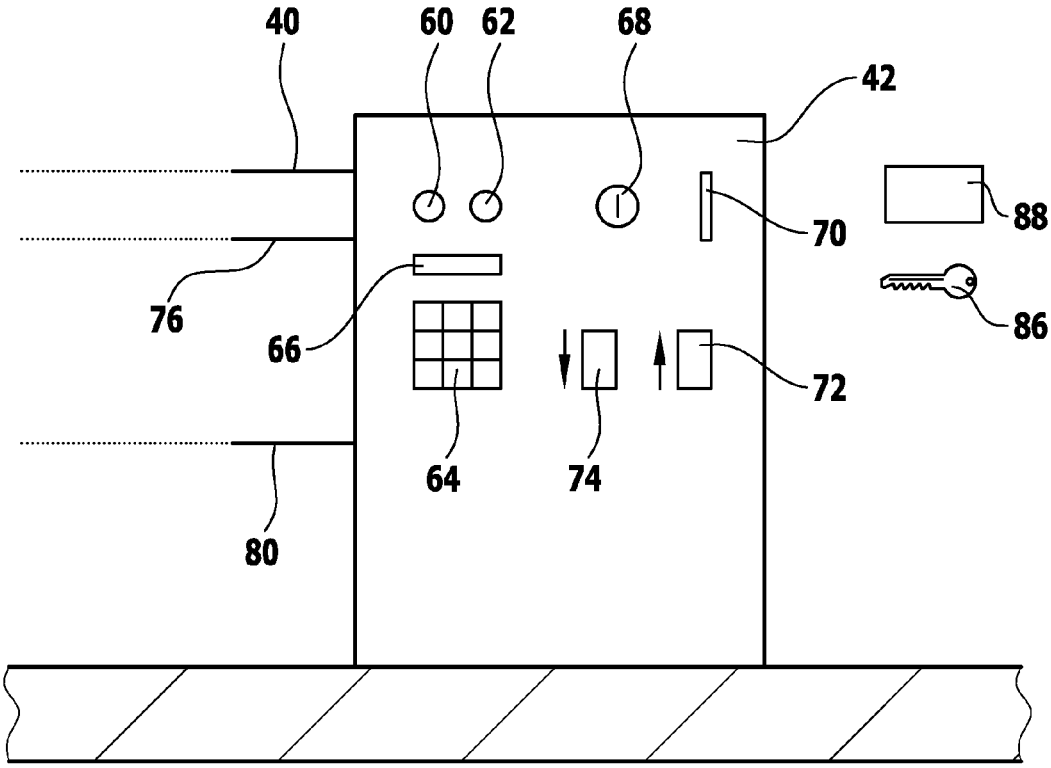
Figure 4:
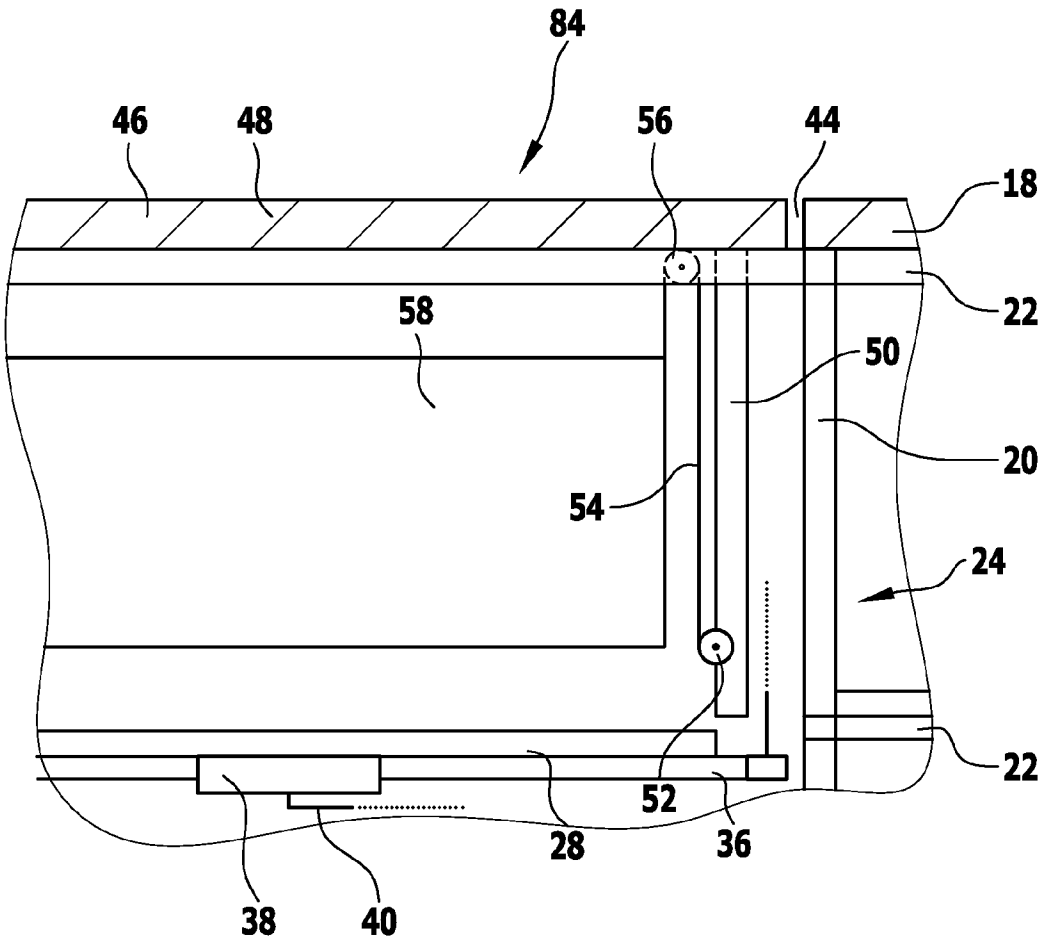

The foregoing summary and the following description may be better understood in conjunction with the drawing figures. These show:

FIG. 1: a schematic partial view of a parking system according to the invention, comprising a transporting device which takes up a change-of-operation position;

FIG. 2: an enlarged illustration of part of the parking system from FIG. 1, wherein the transporting device takes up a transfer position;

FIG. 3: an enlarged, schematic illustration of a control and operating device of the parking system from FIG. 1 and FIG. 4: an enlarged illustration of a detail of the parking system from FIG. 1.

DETAILED DESCRIPTION OF PREFERRED EMBODIMENTS OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a parking system that comprises a plurality of parking spaces for motor vehicles, which parking spaces are arranged next to one another and/or on top of one another and each define a parking position for a motor vehicle, a transfer area defining a transfer position for the motor vehicle for transferring the motor vehicle from the user to the parking system and vice versa, a transporting device for transporting the motor vehicle between the transfer position and a parking position, a control device for controlling the transporting device, and an operating device for the user which is in operative communication with the control device. The control device controls the transporting device in such a manner that the transporting device transports the motor vehicle from a parking position as far as a change-of-operation position, which is arranged on the path of transport from the parking position to the transfer position and vice versa in automatic operation, and that the transporting device transports the motor vehicle from the change-of-operation position to the transfer position and vice versa in dead man operation upon actuation of the operating device by the user.

The parking system according to a preferred embodiment if the invention has two principle modes of operation. Motor vehicles are transported between the change-of-operation position and a parking position by the transporting device in automatic operation, i.e., without involvement on the part of the user, i.e., without the user giving instructions at the operating device during the automatic operation. In comparison, the transport of motor vehicles from the change-of-operation position to the transfer position and vice versa is carried out in dead man operation. For this purpose, it is necessary for the user to actuate the operating device for maintaining the transport of the motor vehicle. If the user refrains from or interrupts the necessary actuation of the operating device, the transport of the motor vehicle from the change-of-operation position to the transfer position and vice versa is omitted or stops, and it will not be started or continued until the operating device is actuated. It may be provided for the operating device to have an operating element which has to be actuated continuously; it is, however, also possible for the operating element to be actuated by the user at points of time which follow one another, in particular, at regular intervals in order to maintain the dead man operation. The operating element which is to be actuated is, for example, a switch, a key, a pedal, a key switch or the like.

The automatic operation makes a rapid transportation of the motor vehicle possible in the interior of the parking system from the change-of-operation position to the parking position and vice versa. The transfer area can, in addition, be designed in a particularly space-saving manner as a result of the change from automatic operation to dead man operation and vice versa. This results from the fact that the maintenance of the dead man operation requires the presence of the user at the operating device when motor vehicles are to be parked and retrieved. This makes it possible to dispense with a lock-like area which includes the transfer area and is otherwise required for security reasons. The parking system according to a preferred embodiment of the invention is, therefore, suitable, in particular, for erecting at locations, at which only very limited constructional space is present for a vehicle access and the transfer area. The transfer area can, for example, also be realized in narrow lanes.

If the motor vehicle takes up the transfer position or the change-of-operation position, this will be designated at the same time as transfer position and change-of-operation position, respectively, of the transporting device. The designations transfer position and change-of-operation position will be used for the position of the transporting device even when no motor vehicle is being transported with the transporting device at that time.

The control device preferably controls the transporting device in such a manner that the transporting device also travels from the transfer position to the change-of-operation position and vice versa in dead man operation without a motor vehicle accommodated thereon. The user must likewise give instructions to the operating device prior to handing over and after collecting the motor vehicle in order to bring the transporting device to the transfer area or remove it from there. This increases the security of the parking system, especially in the absence of a lock-like area.

It is favorable when the parking system has a signal device signaling to the user that the transporting device is taking up the change-of-operation position and/or the transfer position. As a result, it is apparent to the user that the actuation of the operating device is necessary for activating or maintaining the dead man operation or is no longer necessary, depending on whether the motor vehicle is being transported into the parking system or out of the parking system or is to be transported.

It may be provided for the change-of-operation position to be arranged at that point of intersection of two paths of transport which is located closest to the transfer position, the paths of transport each extending from a parking position to the transfer position. The change-of-operation position is arranged in such a manner that, proceeding from the transfer position, it is arranged at the first branching of two paths of transport each leading to a parking position. The dead man operation is, as a result, used only to a slight extent. At the same time it is ensured that the motor vehicles are transported predominantly in automatic operation. This allows, altogether, a more rapid parking and retrieval of motor vehicles.

It is of advantage when the control device controls the transporting device following the positioning of a motor vehicle in the parking position in such a manner that the transporting device travels to the change-of-operation position and remains there. As a result, the average waiting time for users for parking and retrieval of motor vehicles can be kept as small as possible.

In one advantageous embodiment of the parking system according to the invention, it is favorable when the transporting device remains in the change-of-operation position after a motor vehicle has been transferred to the user and the transporting device has traveled to this change-of-operation position. This likewise serves to shorten the average waiting time of the users of the parking system. For example, it may be provided in the case of a parking system, with which the motor vehicles are positioned on pallets, for the transporting device to remain in the change-of-operation position after a motor vehicle has been transferred to the user and the transporting device has traveled with an empty pallet to this change-of-operation position.

In the case of a different type of embodiment of a parking system with pallets, it may be provided for the control device to control the transporting device, after the motor vehicle has been transferred to the user and the transporting device has traveled to the change-of-operation position, to place the empty pallet in a parking space and travel to the change-of-operation position without a pallet. This also allows the average waiting time for users to be kept as small as possible.

The parking system preferably has an entry opening for the motor vehicle, through which the motor vehicle can be transported from the transfer area to the area of the parking system provided with parking spaces, as well as a cover for closing the entry opening in a closed position when the transporting device takes up the change-of-operation position and for opening the entry opening in an opened position when the transporting device takes up the transfer position. The cover makes it possible to close the entry opening for the protection of the parking system and of people when the parking system is operating in automatic operation. The entry opening is, on the other hand, open for the transfer of motor vehicles when the transporting device takes up the transfer position.

The transporting device preferably reaches the change-of-operation position, when transferring from the transfer position to the change-of-operation position, when, and, in particular, exactly when the cover reaches the closed position during its transfer from the opened position into the closed position and closes the entry opening. This allows the dead man operation to be reduced to a minimum if the entry opening is intended to be closed when automatic operation is started up.

In a corresponding manner, it is possible to start transferring the cover from the closed position into the opened position in order to open the entry opening with the start up of the dead man operation when the transporting device is traveling from the change-of-operation position to the transfer position.

In one particular configuration of the parking system according to the invention, it proves to be favorable when the entry opening is formed in a ground surface and when the cover closes the entry opening in the closed position on a level with the ground or essentially on a level with the ground. The area of the parking system provided with parking spaces is formed, in particular, in a pit beneath the surface of the ground and so motor vehicles are transported through the ground surface for parking in the parking system and for retrieval from the parking system. The cover which is on a level with the ground in the closed position can form a component of a roadway which extends over the entry opening and beyond and can be used as vehicle access to or exit from the parking system.

The parking system can be designed in a constructionally simple and inexpensive manner when the cover is adapted to be coupled to the transporting device mechanically, wherein it is transferred by the transporting device from the closed position into the opened position and vice versa when the transporting device travels from the change-of-operation position to the transfer position and vice versa. As a result, a separate drive for the cover can be dispensed with. Not only can a motor vehicle, for example, on a pallet be transported by means of the transporting device but also the cover transferred from the closed position into the opened position and vice versa.

Furthermore, it is favorable in a constructionally simple configuration of the parking system when the cover comprises at least one support which moves into abutment on the transporting device when the transporting device is traveling from the change-of-operation position to the transfer position and so the cover is raised by the transporting device. This is suitable, in particular, for a failure-free and constructionally simple operation in the case of the embodiment of the parking system according to the invention as second last described. If the transporting device is raised from the change-of-operation position into the transfer position, the cover closing the entry opening on a level with the ground will be lifted at the same time away from the ground surface and thus open the entry opening. In the reverse way, the cover will be lowered when the transporting device is lowered into the change-of-operation position and so the entry opening can be closed again "automatically".

In order to keep the requirements placed on a drive for the cover slight, it can be provided for the parking system to comprise a counterweight which is coupled to the cover and is operative when the cover is transferred from the closed position into the opened position and vice versa. This allows a drive for the cover to be of a less powerful design.

At least one authorization carrier is preferably associated with the operating device for its actuation by the user since this allows any unauthorized use of the parking system to be excluded. The at least one authorization carrier is, for example, a key or a chip card.

The at least one authorization carrier is favorably allocated to a specific parking space and contains information relating to the parking space which can be read by the operating device and made available to the control device. This makes a user-friendly operation possible, during which it is apparent on the basis of the authorization carrier, to which parking space the motor vehicle of the user is to be transported or from which parking space it is to be retrieved. A separate input of the number of the parking space or the like by the user is not required.

It is of advantage when the operating device comprises at least one receptacle, in which the at least one authorization carrier is to be arranged for actuating the operating device and when the control device blocks the release of the at least one authorization carrier from the at least one receptacle for such a time until the transporting device has traveled from the transfer position to the change-of-operation position. This allows it to be ensured, not only during the parking but also during the retrieval of motor vehicles, that the transporting device is again located in the change-of-operation position before the user can leave the parking system since the authorization carrier is not released by the operating device before that. This has proven to be advantageous, in particular, when, as explained above, the entry opening of the parking system is closed by means of a cover as a result of the transporting device traveling from the transfer position to the change-of-operation position at the same time. In this case, the user cannot leave the parking system until the entry opening is closed. This increases the security of the parking system.

The parking system preferably has an exit limiting device which can be transferred from an opened state into a closed state and vice versa for limiting an exit from the transfer area.

In this respect, it is favorable when the control device controls a drive of the exit limiting device, after the motor vehicle has been transferred to a user and the transporting device has subsequently traveled to the change-of-operation position, in such a manner that the exit limiting device is transferred into the opened state. This allows a user-friendly control of the parking system. The exit limiting device is opened, in a way, "automatically" without any further actuation by the user being required.

A parking system 10 according to an aspect of the invention is configured essentially as an underground parking system with a vehicle access 12 and exit 14 on a level with the ground. In a pit 16 formed in the earth, which is limited at the top by a ground surface 18 forming the vehicle access 12 and vehicle exit 14, the parking system 10 comprises a parking rack 24 which is formed from vertical supports 20 and horizontal supports 22. A parking space 26, also designated as a "compartment", is formed on a horizontal support 24 between two respective vertical supports 20. A pallet 28 accommodating a motor vehicle 30 can be placed on or stored in each parking space 26. This defines a parking position of the motor vehicle 30.

The parking system 10 is configured such that the parking rack 24 comprises four rows of parking spaces 26, in each of which only motor vehicles 30 which are parked one above the other can be positioned. In this respect, two rows of parking spaces are arranged each time on oppositely located sides of a central transport shaft 32. It is conceivable, alternatively or in addition, for parking spaces 26 to also be formed in several rows next to one another in a depth direction in the parking rack 24, i.e., in a way, parallel to the plane of drawing.

A transporting device 36 is arranged in the transport shaft 32 so as to be movable in a vertical direction illustrated by a double arrow 34. The pallets 28 can, therefore, be transported up and down in the transport shaft 32 by means of the transporting device 36. In addition, the pallets 28 can be moved in a horizontal direction into the parking spaces 26 to take up the parking position and be collected from it in a manner which is known per se and not explained in greater detail for this reason.

The transporting device 36 comprises a drive 38 which is in operative connection with an integrated control and operating device, designated in the following as control device 42, via a control line 40. This allows the control of the transporting device 36 by the control device 42. The control device 42 is illustrated schematically in detail in FIG. 3.

At the top, the transport shaft 32 has an entry opening 44 which is formed in the ground surface 18 and through which motor vehicles 30 can be transported into the area of the parking system 10 provided with parking spaces 26 or be transported out of it. A cover 46 is associated with the entry opening 44, the cover 46 being adapted to close the entry opening 44 in a closed position (FIG. 1) and to open it in an opened position (FIG. 2). The cover 46 comprises a lid 48 which can be inserted into the entry opening 44 more or less free from clearance and closes the entry opening 44 on a level with the ground in the closed position of the cover 46 and, therefore, forms, as it were, a connection between the vehicle access 12 and the exit 14. Furthermore, the cover 46 comprises four identical supports 50 which extend from the lid 48 in a vertical direction into the transport shaft 32 and of which only two supports 50 are shown in the drawings.

A chain 54 is held on each of the supports 50 via a deflection roller 52, this is apparent from FIG. 4, and the chain 54 is connected to a counterweight 58 via an additional deflection roller 56 which is secured to a horizontal support 22 which is illustrated only in FIG. 4. During the raising and lowering of the cover 46 described in the following, the counterweight 58 will become active in order to minimize the force required for this purpose.

The area of the parking system 10, in which the entry opening 44 is arranged, is designated as transfer area 84, at which a motor vehicle 30 can be transferred to the parking system 10 or the motor vehicle 30 can be transferred to a user from here. If the transporting device 36 is located in the entry opening 44, a pallet 28 arranged on the transporting device 36 is aligned on a level with the ground. This defines a transfer position of the transporting device 36 as well as of the motor vehicle 30 (FIG. 2).

If the transporting device 36 is raised in the transport shaft 32 in the direction of the cover 46, the supports 50 can move to abutment on the transporting device 36 on its upper side—cf. FIG. 1 in contrast to FIG. 4, in which the transporting device 36 is shown at a distance from the supports 50. If the supports 50 abut on the transporting device 36 and the cover 46 takes up the closed position, this defines a change-of-operation position of the transporting device 36 as well as of a motor vehicle 30 possibly positioned on it (FIG. 1).

The supports 50 are dimensioned such that the transporting device 36, in the change-of-operation position, is arranged at that point of intersection of two paths of transport which is located closest to the change-of-operation position, the paths of transport each extending from the change-of-operation position to two respective parking positions in the parking spaces 26. As a result, the transporting device 36, in the change-of-operation position, is located directly beneath the entry opening 44, namely in such a manner that it is arranged approximately in a plane with pallets 28 of the uppermost horizontal support 22 of the parking rack 24 which is provided with parking spaces 26.

The integrated control and operating device (control device 42) which is arranged a few meters to the side next to the entry opening 44 comprises a signal device with two signal lamps 60 and 62, a numeric keypad 64 with associated display 66, a key slot 68 for receiving an authorization carrier in the form of a key 86, an insertion shaft 70 for receiving an authorization carrier in the form of a key card 88, a raise key 72 as well as a lower key 74 for the raising and lowering of the transporting device 36, respectively, described in the following.

The control device 42 is connected via a signal line 76 to a sensor element 78 of the transporting device 36. The position, in which the transporting device 36 is located in the transport shaft 32, can be detected by means of the sensor element 78.

The control device 42 is connected via a control line 80 to a drive of an exit limiting device in the form of a barrier 82 which is arranged at the exit 14 such that with control by the control device 42 the barrier 82 can be transferred from an opened into a closed state and vice versa.

The parking system 10, explained in the following with the example of the parking of a motor vehicle 30, functions in the following manner:

A user leaves his motor vehicle 30 at the vehicle access 12 in order to activate the control device 42 by means of an authorization carrier, such as the key 86 which is to be inserted into the key slot 68 or the key card 88 which is to be inserted into the insertion shaft 70. The key card 88 contains the information as to which of the parking spaces 26 is allocated to the user. When a key 86 is used, the number of the parking space can be entered via the numeric keypad 64 and controlled at the display 66.

Insofar as one is not already present, the transporting device 36 collects an empty pallet 28 from the parking rack 24 and travels to the change-of-operation position, i.e., the control device 42 controls the drive 38 of the transporting device 36 in a corresponding manner such that this takes place (FIG. 1). The movement of the transporting device 36 to the change-of-operation position occurs rapidly in automatic operation, i.e., without instructions of the user needing to be given at the control device 42 for this purpose.

The taking up of the change-of-operation position can be detected by means of the sensor element 78 and transmitted to the control device 42 via the signal line 76. The taking up of the change-of-operation position will be signaled to the user by the signal lamp 60 lighting up. The further transport of the pallet 28 into the transfer position takes place in dead man operation, wherein for this purpose a continuous actuation of the raise key 72 by the user is required. Only when the raise key 72 is actuated continuously will the control device 42 control the drive 38 in such a manner that the transporting device 36 is raised until it takes up the transfer position (FIG. 2).

Alternatively, it may be provided for the raise key 72 not to have to be actuated continuously but rather at intervals following one another, in particular, regularly. In any case, an instruction from the user at the control device 42 is required in order to activate or maintain the dead man operation.

When the transporting device 36 is raised from the change-of-operation position to the transfer position, the vertical supports 50 of the cover 46 are in abutment on the transporting device 36. As a result, the cover 46 will be transferred from the closed position into the opened position so that the entry opening 44 is automatically opened without a separate drive for the cover 46 being necessary for this purpose. The counterweight 58 allows the load on the drive 38 to be reduced.

If the transporting device 36 takes up the transfer position, this is detected by the sensor element 78 and transmitted via the signal line 76 to the control device 42. As a result, this activates the signal lamp 62. The user can then position the motor vehicle 30 on the empty pallet 28.

To park the motor vehicle 30, the user must transfer the transporting device 36 in dead man operation into the change-of-operation position. This takes place by way of continuous actuation of the lower key 74, wherein in this case, as well, actuation is conceivable at intervals which follow one another, in particular, regularly. At the same time, the cover 46 is lowered.

Other operating elements can also be provided at the control device 42 for the purpose of maintaining the dead man operation, for example, a pedal or a key switch which is actuated as a result of continuous actuation by means of the key 86.

If the transporting device 36 reaches the change-of-operation position, the cover 46 takes up the closed position as defined and the entry opening 44 will just be closed with the lid. The signal lamps 60 and 62 go out and the further transport of the pallet 28 is again brought about in automatic operation without instructions from the user at the control device 42 being required for this purpose. During automatic operation, the transporting device 36 transports the pallet 28 to the parking space 26 allocated to the user and passes the motor vehicle 30 to this space. Once the motor vehicle 30 has been parked, the transporting device 36 travels in automatic operation again to the change-of-operation position and remains there. As a result, the average reaction time of the parking system can be kept as small as possible.

The change of the mode of operation of the transporting device 36 from automatic operation to dead man operation and vice versa has two advantages:

On the one hand, during automatic operation, a rapid transport of the pallets 28 as well as, where applicable, of motor vehicles 30 arranged on them can take place. During dead man operation, on the other hand, the safety of the user can be guaranteed. Since an instruction from the user at the control device 42 is required for maintaining the dead man operation, the user must stay a certain distance from the entry opening 44. As a result, when the parking system 10 is used in accordance with its determination it is ensured that the user can neither get into the interior of the parking system 10 through the entry opening 44 nor injure himself on the cover 46 which is moving. This has the additional advantage that in the transfer area 84 no lock-like area is required for the transfer of the motor vehicle 30 to the parking system 10. This makes it possible to also arrange the transfer area 84 at very narrow and constricted locations where there is insufficient space for a lock-like area, for example, in narrow lanes. In addition, when a lock-like area is dispensed with the lid 48 can be used as a roadway between the vehicle access 12 and the exit 14. This also makes the arrangement of the transfer area 84, for example, in narrow lanes possible.

As long as the transporting device 36 is being operated in dead man operation, the key 86 in the key slot 68 or the key card 88 in the insertion shaft 70 are blocked by the control device 42. This represents an additional safety function. As a result, it is ensured that the user must lower the transporting device 36 again in any case as far as the change-of-operation position and, as a result, close the entry opening 44 by means of the lid 48 at the same time so that he can remove the key 86 or the key card 88 from the control device 42. Only then can he leave the parking system 10.

The collection of a motor vehicle 30 from the parking system 10 functions in a corresponding manner: First of all, the pallet 28 accommodating the motor vehicle 30 will be retrieved from the corresponding parking space 26 in automatic operation and the transporting device 36 will travel to the change-of-operation position. Subsequently, the transporting device 36 must be transferred into the transfer position in dead man operation as a result of actuation of the raise key 72, wherein the cover 46 is transferred into the opened position at the same time.

The motor vehicle 30 has subsequently to be driven off the pallet 28. Subsequently, the transporting device 36 has to be lowered into the change-of-operation position in dead man operation by actuation of the lower key 74 and the cover 46 has to be transferred into the closed position. On the one hand, it may now be provided for the transporting device 36 to remain with the empty pallet 28 in the change-of-operation position. It is also possible for the transporting device 36 to position the pallet 28 in an empty parking space 26 in automatic operation and travel to the change-of-operation position without a pallet.

The barrier 82 opens due to control by the control device 42 automatically once the transporting device 36 has traveled into the change-of-operation position and so the user need not actuate the barrier 82 separately.

The invention claimed is:

1. Parking system, comprising:

a plurality of parking spaces for motor vehicles, said parking spaces being arranged next to one another and/or on top of one another and each defining a parking position for a motor vehicle, a transfer area defining a transfer position for a user to leave the motor vehicle and for transferring the unoccupied motor vehicle from the user to the parking system and vice versa, a transporting device for transporting the unoccupied motor vehicle between the transfer position and a parking position, a path of transport for the transporting device, the path of transport running between the transfer position and each of the parking positions via a change-of-operation position;

a control device for controlling the transporting device, and an operating device for the user in operative communication with the control device, the operating device comprising a dead man operating element, the control device controlling the transporting device in such a manner that the transporting device transports the unoccupied motor vehicle from the parking position as far as the change-of-operation position and vice versa in automatic operation, and the transporting device transporting the unoccupied motor vehicle from the change-of-operation position to the transfer position and vice versa in dead man operation upon actuation of the dead man operating element by the user.

2. Parking system as defined in claim 1, wherein the control device controls the transporting device in such a manner that the transporting device also travels from the transfer position to the change-of-operation position and vice versa in dead man operation without a motor vehicle accommodated thereon.

3. Parking system as defined in claim 1, further comprising:

a signal device signaling to the user that the transporting device is taking up the change-of-operation position and/or the transfer position.

4. Parking system as defined in claim 1, wherein:

the path of transport comprises a plurality of paths of transport, each of the plurality of paths of transport running between the transfer position and a corresponding one of the parking spaces;

the change-of-operation position is arranged at a point of intersection of two of the paths of transport located closest to the transfer position, each of the two paths of transport extending from a corresponding one of the parking positions to the transfer position.

5. Parking system as defined in claim 1, wherein the control device controls the transporting device following the positioning of the unoccupied motor vehicle in the parking position in such a manner that the transporting device travels to the change-of-operation position and remains there.

6. Parking system as defined in claim 1, further comprising:

an entry opening for the unoccupied motor vehicle, the unoccupied motor vehicle being transportable through said opening from the transfer area to an area of the parking system provided with parking spaces, and a cover for closing the entry opening in a closed position when the transporting device takes up the change-of-operation position and for opening the entry opening in an opened position when the transporting device takes up the transfer position.

7. Parking system as defined in claim 6, wherein when transferring from the transfer position to the change-of-operation position the transporting device reaches the change-of-operation position when the cover reaches the closed position during its transfer from the opened position into the closed position and closes the entry opening.

8. Parking system as defined in claim 6, wherein:

the entry opening is formed in a ground surface, and the cover closes the entry opening in the closed position on a level with the ground surface or essentially on a level with the ground surface.

9. Parking system as defined in claim 6, wherein:

the cover is adapted to be coupled to the transporting device mechanically, the cover is transferred by the transporting device from the closed position into the opened position and vice versa when the transporting device travels from the change-of-operation position to the transfer position and vice versa.

10. Parking system as defined in claim 9, wherein:

the cover comprises at least one support moving into abutment on the transporting device when the transporting device is traveling from the change-of-operation position to the transfer position, and the cover is raised by the transporting device.

11. Parking system as defined in claim 6, further comprising:

a counterweight coupled to the cover, said counterweight being operative during the transfer of the cover from the closed position into the opened position and vice versa.

12. Parking system as defined in claim 1, wherein at least one authorization carrier is associated with the operating element for its actuation by the user.

13. Parking system as defined in claim 12, wherein the at least one authorization carrier is allocated to a specific parking space and contains information relating to the parking space adapted to be read by the operating device and made available to the control device.

14. Parking system as defined in claim 12, wherein:

the operating device comprises at least one receptacle, the at least one authorization carrier being arranged in said receptacle for actuating the operating element, and the control device blocks the release of the at least one authorization carrier from the at least one receptacle for such a time until the transporting device has traveled from the transfer position to the change-of-operation position.

15. Parking system as defined in claim 1, further comprising:

an exit limiting device transferable from an opened state into a closed state and vice versa for limiting an exit from the transfer area.

16. Parking system as defined in claim 15, wherein the control device controls a drive of the exit limiting device, after the motor vehicle has been transferred to a user and the transporting device has subsequently traveled to the change-of-operation position, in such a manner that the exit limiting device is transferred into the opened state.

17. Parking system as defined in claim 1, wherein the operating element is adapted to be actuated continuously to maintain the dead man operation.

18. Parking system as defined in claim 1, wherein the operating element is adapted to be actuated at regular intervals to maintain the dead man operation.

* * * * *